US006499284B2

(12) United States Patent
Chern et al.

(10) Patent No.: US 6,499,284 B2
(45) Date of Patent: Dec. 31, 2002

(54) TWISTING DEVICE WITH COAXIAL FIBER CAKES AND DUAL OIL RINGS

(75) Inventors: Bih-Cherng Chern, Chia I Hsien (TW); Yung-Cheng Lo, Chia I Hsien (TW)

(73) Assignee: Nittobo Asco Glass Fiber Co., Ltd., Chia-Yi Hsien (TW)

( * ) Notice: Subject to any disclaimer, the term of this patent is extended or adjusted under 35 U.S.C. 154(b) by 0 days.

(21) Appl. No.: 09/776,836

(22) Filed: Feb. 6, 2001

(65) Prior Publication Data

US 2002/0104304 A1 Aug. 8, 2002

(51) Int. Cl.[7] ..... D01H 7/66

(52) U.S. Cl. ..... 57/66; 57/76; 57/90; 57/264; 242/131

(58) Field of Search ..... 242/131; 57/66, 57/76, 90, 264, 58.52

(56) References Cited

U.S. PATENT DOCUMENTS 3,119,224 A * 1/1964 Kocks ..... 57/58.52
3,902,679 A * 9/1975 Bost ..... 242/85
4,736,579 A * 4/1988 Stenmans ..... 57/58.52

* cited by examiner

*Primary Examiner*—John J. Calvert
*Assistant Examiner*—Shaun R Hurley
(74) *Attorney, Agent, or Firm*—Rosenberg, Klein & Lee

(57) ABSTRACT

A twisting device having a pair of fiber cakes that are simultaneously hung on a transversely disposed creel, respectively unwind two fiber strands downwardly during the rotation process of the creel. Each of the two fiber strands passes through a strand-cut sensor and then enter a balloon control ring. Through the guide of an oil ring, each of the fiber strands is twisted and then wound around a bobbin driven by a spindle motor. The pair of balloon control rings and the pair of oil rings are simultaneously driven by a ring rail to move upward and downward on the bobbin.

4 Claims, 9 Drawing Sheets

TWISTING DEVICE WITH COAXIAL FIBER CAKES AND DUAL OIL RINGS

FIELD OF THE INVENTION

The present invention relates to a twisting device having enhanced productivity and, more particularly, to a twisting device, which changes the original one-to-one production structure into a two-to-two or a three-to-three production structure in the original space.

BACKGROUND OF THE INVENTION

FIGS. 1 to 3 show a prior art twisting device, wherein a fiber strand 3 on a fiber cake 2 is connected to a bobbin 5 through the rotation of the fiber cake 2 on a creel 1. The fiber strand 3 between the fiber cake 2 and the bobbin 5 will be twisted through the rotation of a spindle motor 6. The fiber strand 3 after twisting passes through a strand-cut sensor 7 and then is wound around the bobbin 5 driven by the spindle motor 6. The balloon control ring 8 and the oil ring 9 are connected and simultaneously driven by the ring rail 10 to move upwards and downwards outside the bobbin 5. The bobbins 5 are separated one from another by separators 4. The above device is called a twisting machine. The twisting machine shown in the figures are mainly applied to fiberglass. FIGS. 4 and 5 show the structure of a prior art oil ring 9. Oil is supplied to the oil ring 9 via an oil duct 1*a* on the ring rail 10. The oil duct is commonly an oil-supplying pipeline. However, if it is used as a dual-ring type oil ring of the present invention, the situation that oil cannot be supplied to the outer oil ring will happen.

As shown in FIG. 2, when the fiber cakes 2 are installed at the creels 1 of the above twisting machine, the creels 1 will be respectively arranged at the upper part and the lower part of the above machine to let each fiber cake 2 only match a bobbin 5 so as to maximize the use of space. However, this is only an improvement on the height and length of the mechanical structure. Moreover, the bearable weight of the creel 1 far exceeds the weight of the fiber cake 2. That is, the creel is designed to bear more than one fiber cakes. Although the prior art structure has been improved on the basic one-to-one twisting structure, it has the problem that the productivity cannot be further expanded using the same space.

SUMMARY OF THE INVENTION

One object of the present invention is to provide a twisting device having enhanced productivity, wherein a bobbin is added to each single set in the width direction of the machine, and a pair of fiber cakes are simultaneously placed on a creel in the original space configuration. The fiber cake is designed to have only a half width of the original fiber cake. Under the premise of the same weight of a fiber cake, the thickness of the fiber cake is increased so that two fiber cakes can be received in the structure of the creel. The original one-to-one production structure is thus changed into a two-to-two production structure. Therefore, the productivity can be doubled, and the cost of machines can be reduced. In other words, a machine of double productivity is obtained, and a half area of the twisting production line can be saved. Briefly, the productivity per unit time per unit ground area is doubled. The above method can also be used to expand the structure of a twisting machine into a three-to-three or a four-to-four structure.

To achieve the above object, a pair of fiber cakes are simultaneously hung on a transversely hung creel. The pair of fiber cakes respectively unloosen two fiber strands downwards during the rotation process of the creel. Each of the two fiber strands passes through a strand-cut sensor and then enters a balloon control ring. Through the guide of an oil ring, each of the fiber strands is twisted and then wound around a bobbin driven by a spindle motor. The pair of balloon control rings and the pair of oil rings are simultaneously driven by a ring rail to move upwards and downwards on the bobbin. Therefore, a pair of fiber strands and a pair of bobbins can use the same creel.

The various objects and advantages of the present invention will be more readily understood from the following detailed description when read in conjunction with the appended drawings, in which:

DETAILED DESCRIPTION OF THE PREFERRED EMBODIMENTS

Figure 6:
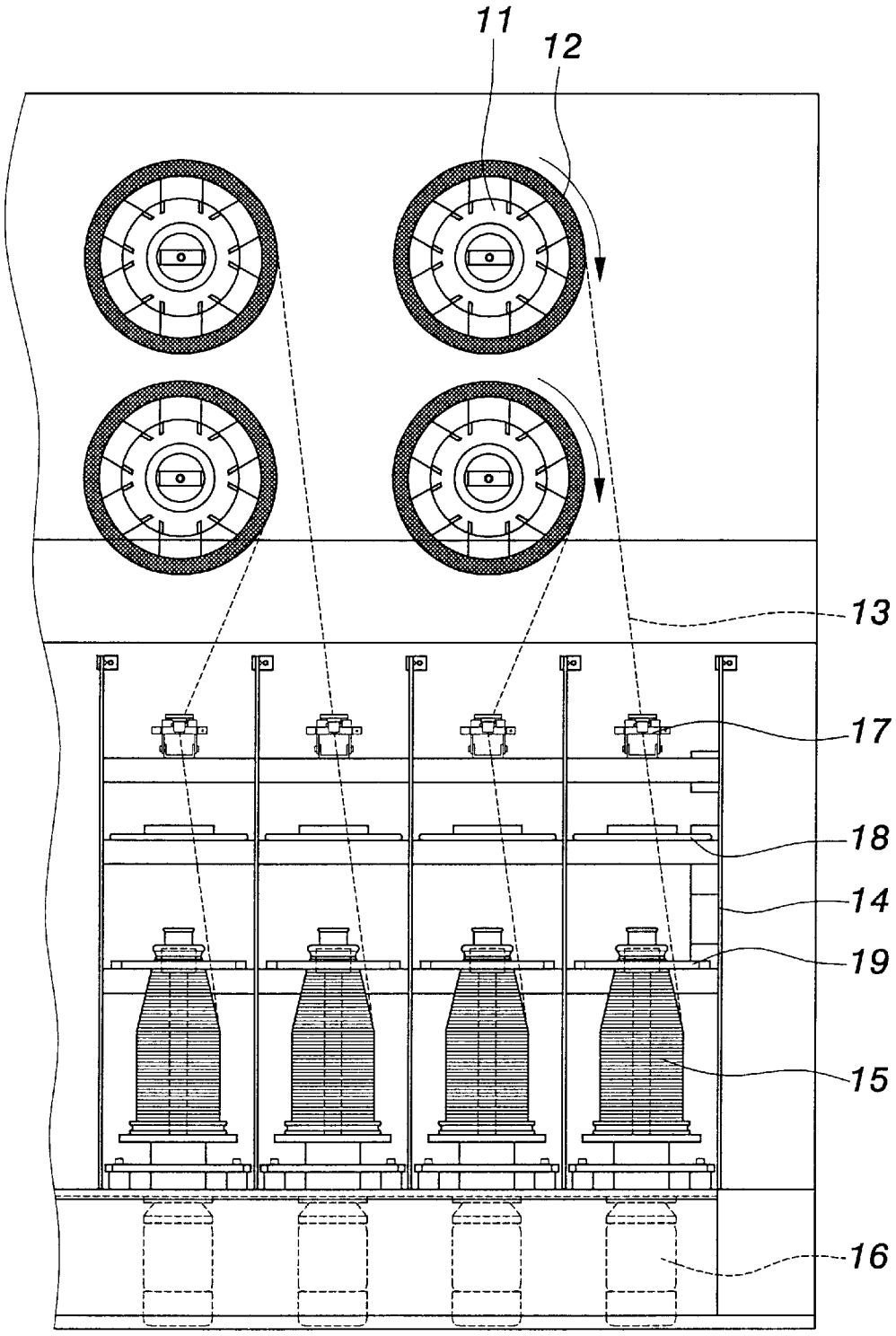
FIG. 6 is a front view of the present invention.
Figure 7:
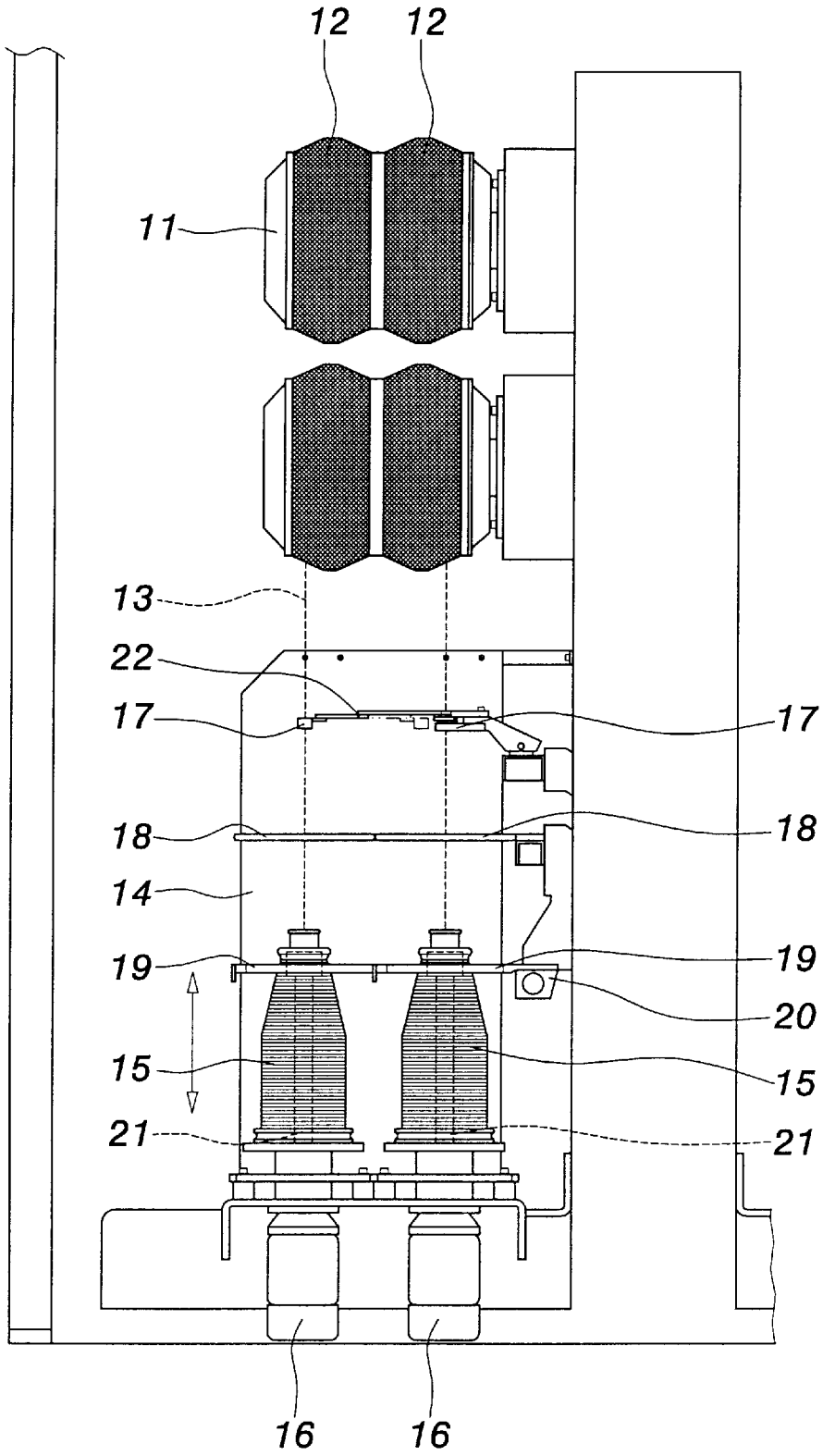
FIG. 7 is a side view of the present invention.
Figure 8:
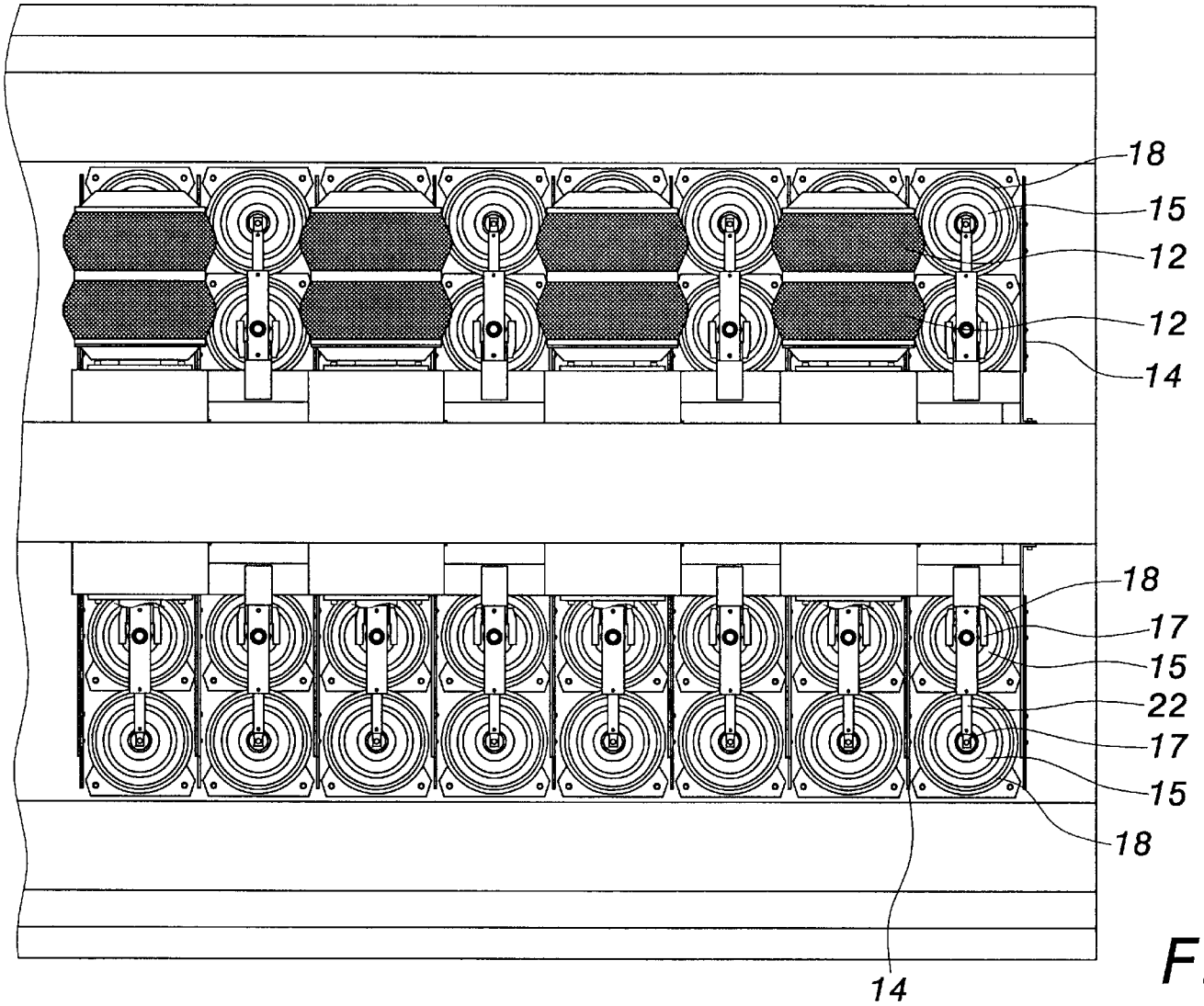
FIG. 8 is a top view of the present invention.

FIGS. 6 to 8 show a twisting device having enhanced productivity of the present invention. A pair of fiber cakes 12 are simultaneously hung on a transversely hung creel 11. The pair of fiber cakes 12 respectively unloosen two fiber strands 13 downwards during the rotation process of the creel 11. Each of the two fiber strands 13 passes through a strand-cut sensor 17 and then enters a balloon control ring 18. Through the guide of an oil ring 19, each of the two fiber strands 13 is twisted and then wound around a bobbin 15. Each of the bobbins 15 is placed on a spindle plate 21 and driven by a spindle motor 16. The pair of balloon control rings 18 and the pair of oil rings 19 are connected to a ring rail 20. All pairs of the bobbins 15 are separated one from another by separators 14. The balloon control rings 18 and the oil rings 19 are simultaneously driven by the ring rail 20 to move upwards and downwards on outside the bobbins 15. Therefore, a pair of fiber cakes 12 and a pair of bobbins 15 can use the same creel 11.

Figure 11:
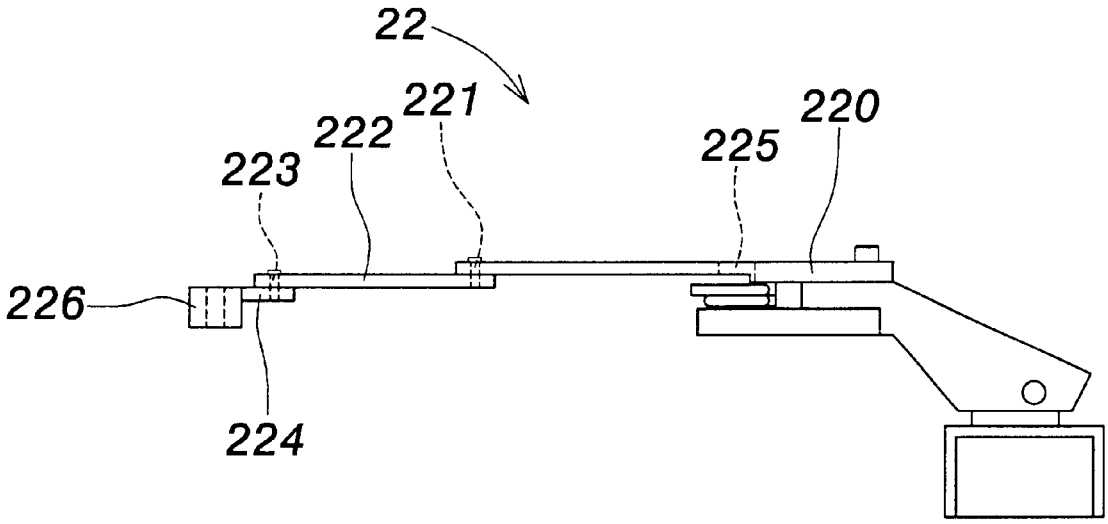
FIG. 11 is a side view of an unfolded strand-cut sensor of the present invention.
Figure 12:
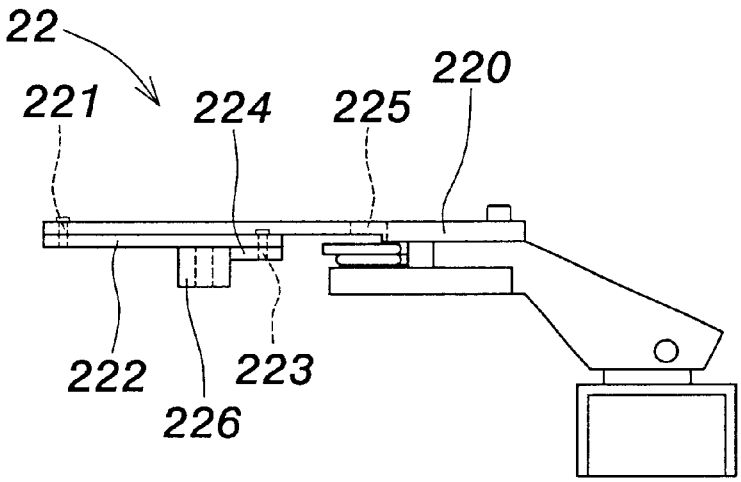
FIG. 12 is a side view of a folded strand-cut sensor of the present invention.

A supporter 22 of the strand-cut sensor 17 is of inflectional shape, as shown in FIGS. 7, 11, and 12, which has a supporter plate 220. The supporter plate 220 uses the first axis 221 to join the first supporter plate 222, which then uses the second axis 223 to join the second supporter plate 224. An outside strand-cut sensor 226 is joined on the second supporter plate 224. An inside strand-cut sensor 225 is joined in the supporter plate 220. The outside structures can be folded to form a structure that bobbin can be replaced more conveniently. After used, the second supporter plate 224 is first folded and hidden below the first supporter plate 222, and the first supporter plate 22 is then folded below the supporter plate 220.

Figure 9:
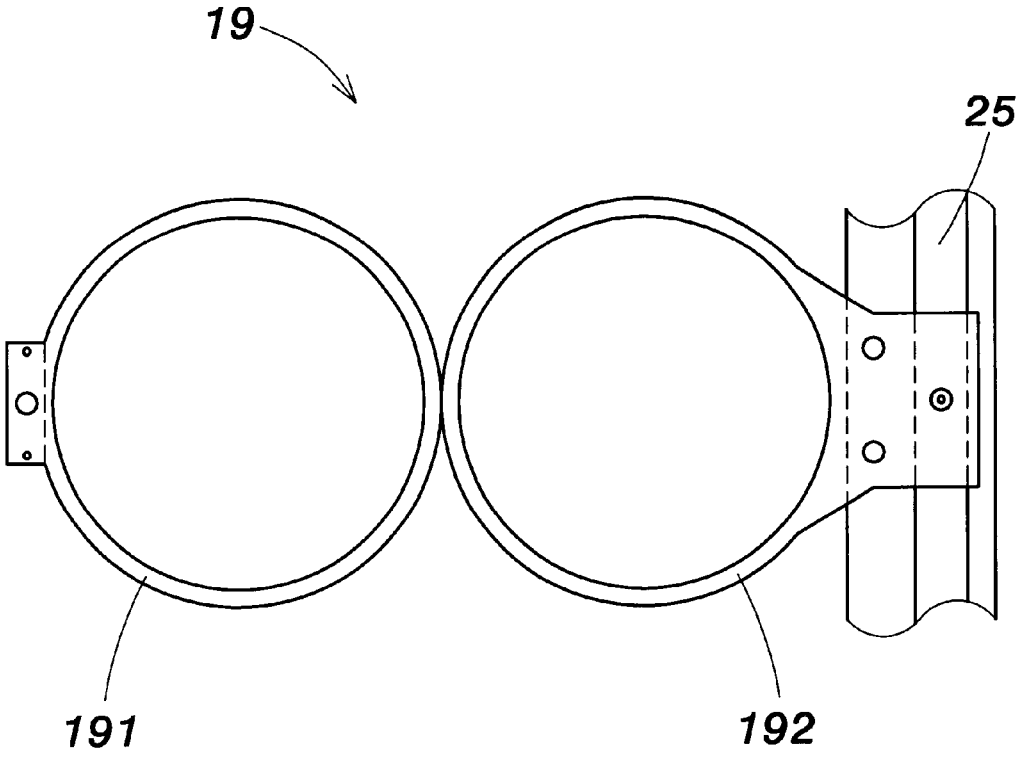
FIG. 9 is a top view of an oil ring of the present invention.
Figure 10:
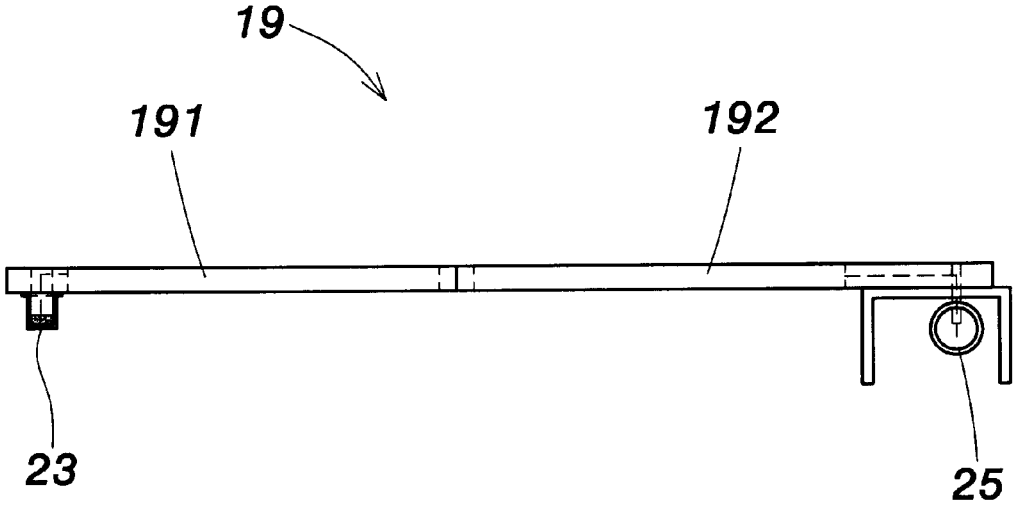
FIG. 10 is a front view of an oil ring of the present invention.

FIGS. 9 and 10 show a dual-ring type oil ring 19, which has an oil cup 23 added on the outside oil ring 191 thereof and an oil duct 25 to supply the inside oil ring 192. The oil cup 223 is used to provide oil for the outside oil ring 191. Moreover, because the ring rail 20 is connected to the inside oil ring 192, and the whole oil ring is designed to have a smaller weight, the oil ring 19 can be raised or lowered more stably. Therefore, in the multi-ring type oil ring 19, the oil ring 191 is joined with the oil ring 192, each ring having a direct oil-supplying device (an oil cup 23 or an individual oil-supplying pipeline 25).

Figure 1:
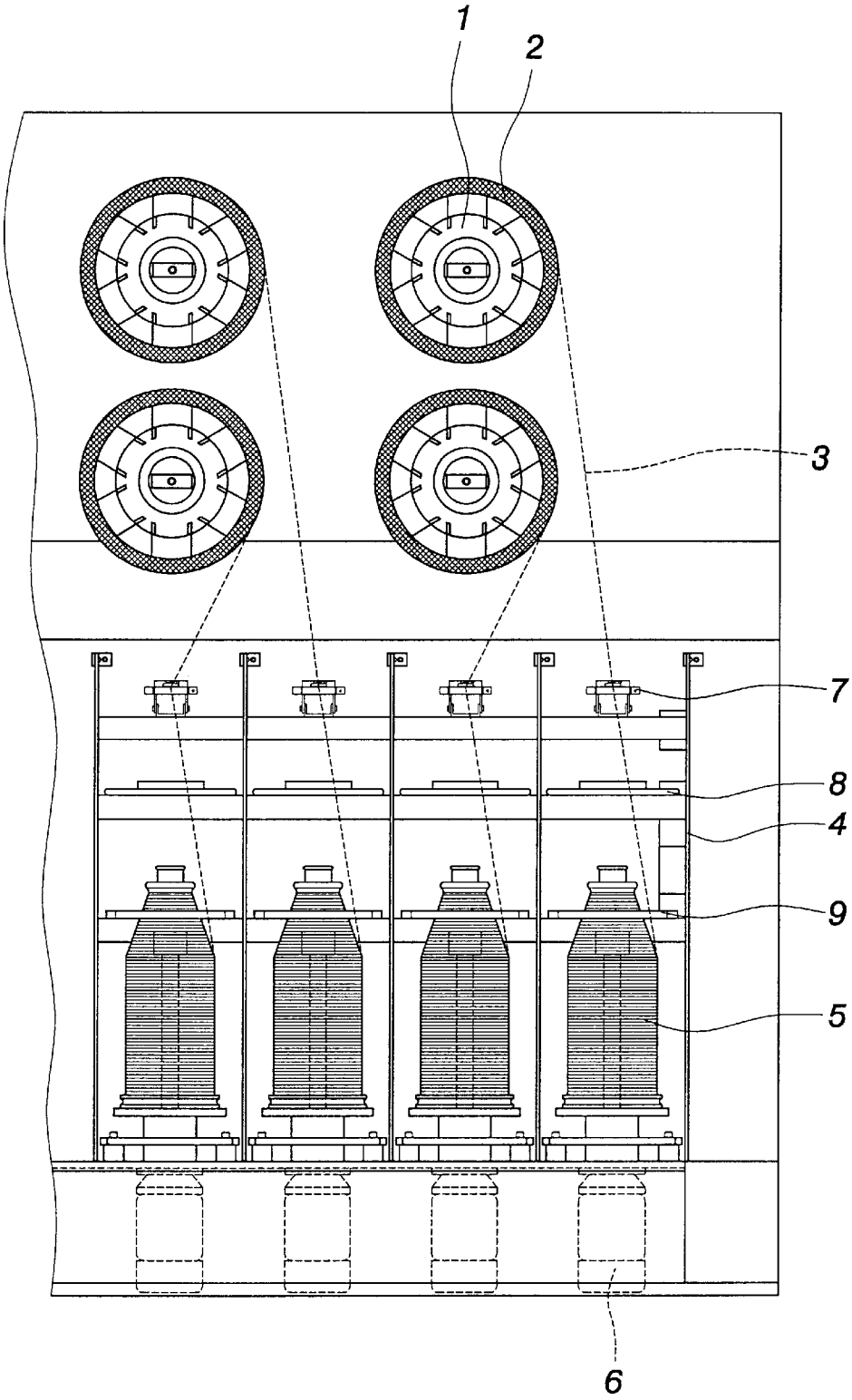
FIG. 1 PRIOR ART
FIG. 1 is a front view of a prior art twisting device.
Figure 2:
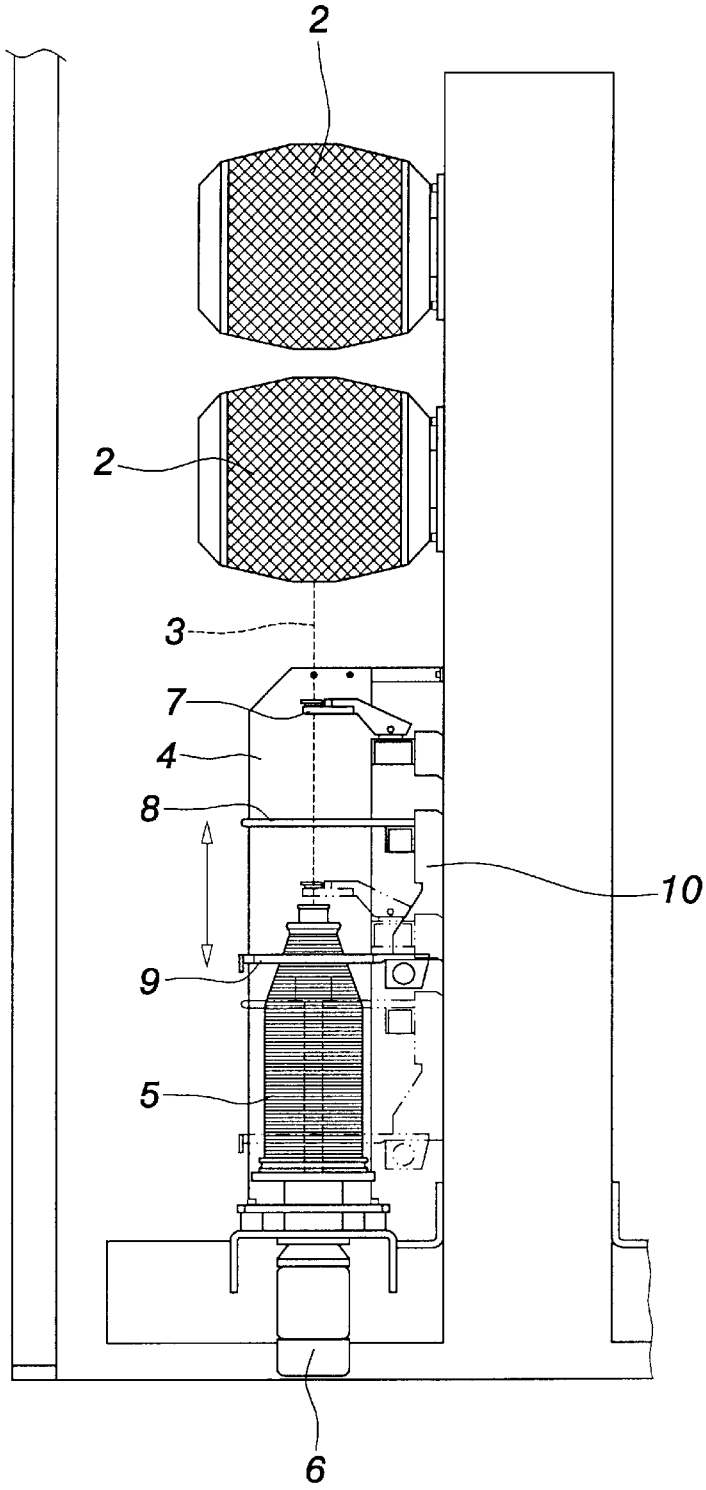
FIG. 2 PRIOR ART
FIG. 2 is a side view of a prior art twisting device.
Figure 3:
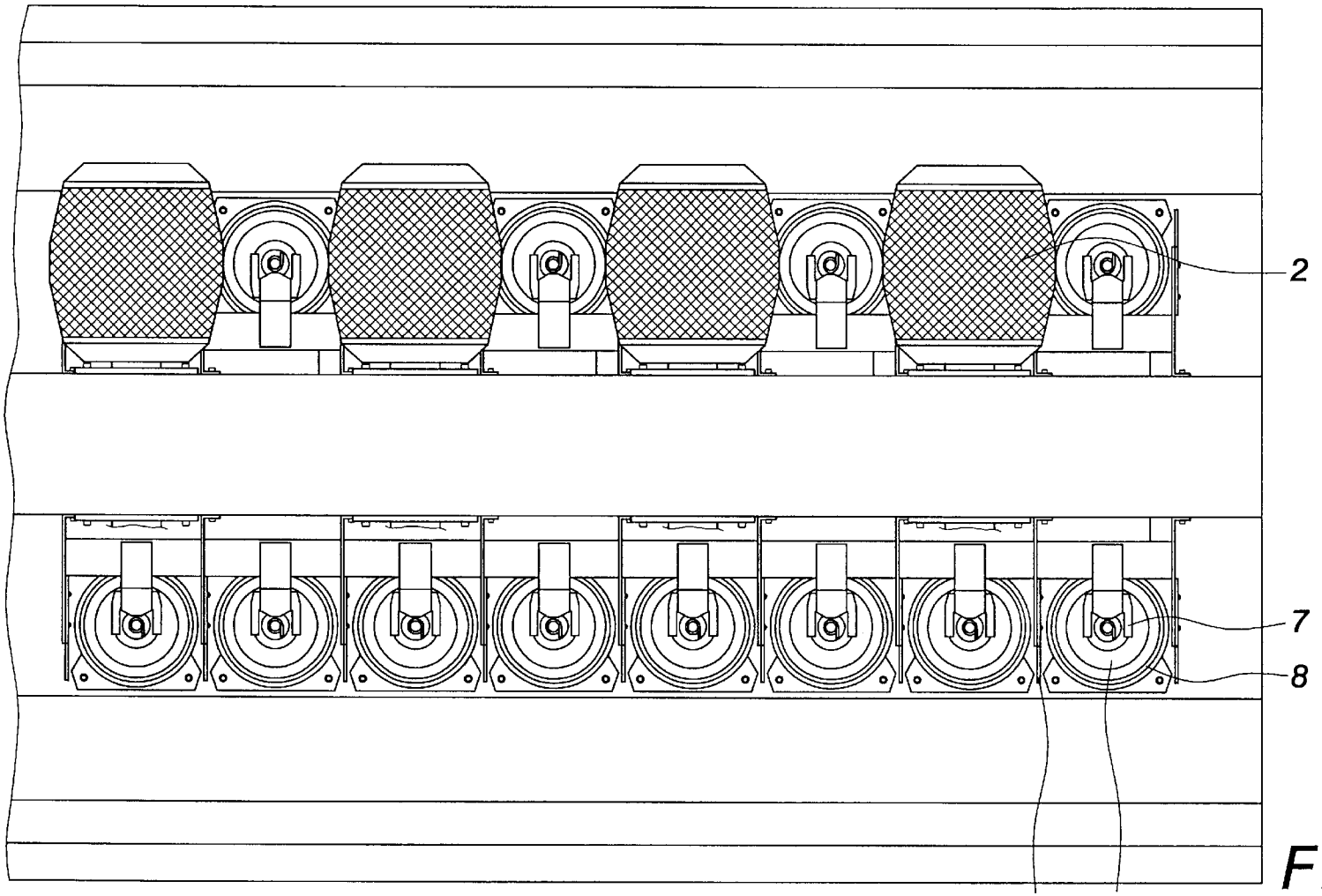
FIG. 3 PRIOR ART
FIG. 3 is a top view of a prior art twisting device.
Figure 4:
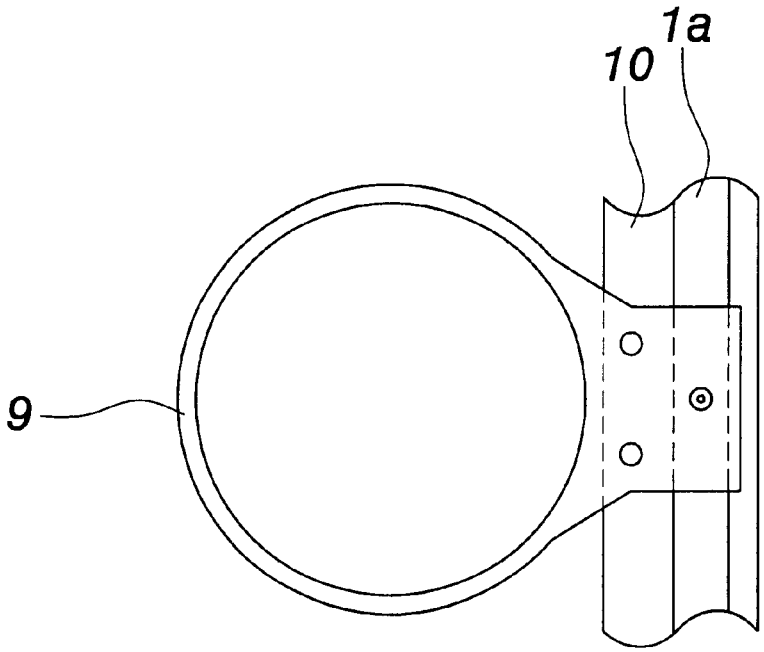
FIG. 4 PRIOR ART
FIG. 4 is a top view of a prior art oil ring.
Figure 5:
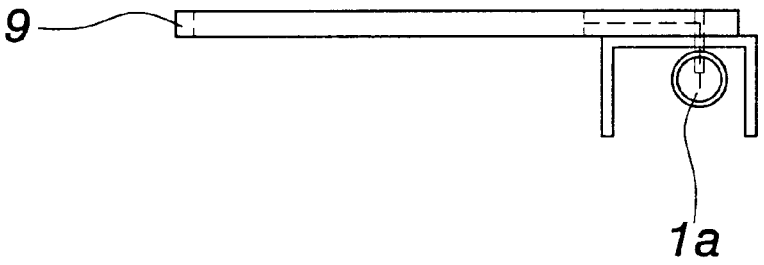
FIG. 5 PRIOR ART
FIG. 5 is a front view of a prior art oil ring.

Space is fully exploited in the present invention. In the prior art, the creels are arranged up and down, each matching a bobbin arranged at the same row, as shown in FIG. 1. In the present invention, the creels are also arranged up and down, but a pair of fiber cakes are provided on the same creel to match two bobbins arranged fore and aft below, as shown in FIGS. 7 and 8. Thereby, the productivity per unit ground area per unit time can be doubled. The weight of a single fiber cake received in the creel is the same as that of the prior art shown in FIG. 3. Because the fiber cake of the present invention is narrower but thicker while the fiber cake in the prior art is wider but thinner, the weight of a single fiber cake of the present invention is equal to that of the prior art. Therefore, better use can be provided. Additionally, the above embodiment illustrates the present invention using a pair of fiber cakes provided on a creel to match a pair of bobbins. Similarly, more than two fiber cakes can be provided on a creel to match the same number of bobbins in the present invention.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

We claim:

1. A twisting device having enhanced productivity, comprising:

a creel;

at least two fiber cakes coaxially and rotatably arranged on said creel, each of said fiber cakes having a respective fiber strand unwindable therefrom to extend downwardly;

at least a pair of strand-cut sensors disposed below said creel, each of said fiber strands passing through a respective one of said pair of strand cut sensors;

a ring rail disposed at a lower portion of said twisting device and being reciprocally driven upwardly and downwardly;

at least two balloon control rings respectively disposed beneath said strand-cut sensors and coupled to said ring rail for displacement therewith;

at least a pair of oil rings respectively disposed beneath said balloon control and coupled to said ring rail for displacement therewith, each said oil ring being joined with the other oil ring and each having an oil-supplying device; and, at least two bobbins respectively disposed below said oil rings, each of said fiber strands passing through a respective one of said balloon control rings and a corresponding one of said oil rings to a respective one of said bobbins, each of said bobbins being rotatably driven to twist each respective one of said fiber strands and respectively wind each said twisted fiber strand on a corresponding one of said bobbins.

2. The twisting device having enhanced productivity as claimed in claim 1, wherein at least one of said oil-supplying devices is an oil cup.

3. The twisting device having enhanced productivity as claimed in claim 1, wherein said strand-cut sensors are mounted to a supporter, said supporter including:

(a) a supporter plate, one of said strand-cut sensors being mounted to said supporter plate;

(b) a first member having a first end thereof pivotally coupled to said supporter plate to be foldable beneath said supporter plate; and, (c) a second member pivotally coupled to a second end of said first member to be foldable beneath said first member, the other of said strand-cut sensors being mounted to said second member.

4. A twisting device having enhanced productivity, comprising:

a creel;

at least two fiber cakes coaxially and rotatably arranged on said creel, each of said fiber cakes having a respective fiber strand unwindable therefrom to extend downwardly;

at least two strand-cut sensors disposed below said creel, each of said fiber strands passing through a respective one of said strand-cut sensors;

at least two balloon control rings and at least two oil rings respectively provided below said strand-cut sensors, said oil rings being disposed below said balloon control rings, said balloon control rings and said oil rings being connected to and driven by a ring rail to make upward and downward reciprocal motions; and at least two bobbins provided below said oil rings and being rotatably driven so that said fiber strands are each respectively twisted and then each wound on a corresponding one of said bobbins, said strand-cut sensors being mounted to a supporter, said supporter including:

(a) a supporter plate, one of said strand-cut sensors being mounted to said supporter plate;

(b) a first member having a first end thereof pivotally coupled to said supporter plate to be foldable beneath said supporter plate; and, (c) a second member pivotally coupled to a second end of said first member to be foldable beneath said first member, the other of said strand-cut sensors being mounted to said second member.

* * * * *